US010079124B2

(12) United States Patent
Liang et al.

(10) Patent No.: US 10,079,124 B2
(45) Date of Patent: Sep. 18, 2018

(54) KEYCAP AND KEYBOARD APPARATUS

(71) Applicants: LITE-ON ELECTRONICS (GUANGZHOU) LIMITED, Guangzhou (CN); LITE-ON TECHNOLOGY CORPORATION, Taipei (TW)

(72) Inventors: Xiao-Qiang Liang, Jiang Su (CN); Lei Shi, Jiang Su (CN); Xue-Lei Liu, Jiang Su (CN)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 169 days.

(21) Appl. No.: 15/225,616

(22) Filed: Aug. 1, 2016

(65) Prior Publication Data

US 2017/0207040 A1 Jul. 20, 2017

(30) Foreign Application Priority Data

Jan. 20, 2016 (CN) ..... 2016 1 0037193

(51) Int. Cl.
*H01H 13/70* (2006.01)
*H01H 13/88* (2006.01)

(52) U.S. Cl.
CPC ..... *H01H 13/70* (2013.01); *H01H 13/88* (2013.01); *H01H 2233/07* (2013.01); *H01H 2239/056* (2013.01)

(58) Field of Classification Search
CPC .... H01H 13/70; H01H 13/88; H01H 2233/07; H01H 2239/056; H01H 13/14; H01H 3/125; H01H 11/00; H01H 2219/028; H01H 2221/00; H01H 2229/00
USPC ..... 200/5 A, 341
See application file for complete search history.

(56) References Cited

U.S. PATENT DOCUMENTS 7,882,798 B2 * 2/2011 Lin ..... B05B 13/02 118/500
2011/0127152 A1 * 6/2011 Hu ..... H01H 3/125 200/5 A
2012/0048704 A1 * 3/2012 Tsai ..... H01H 13/14 200/5 A

FOREIGN PATENT DOCUMENTS

CN 105070563 A † 11/2015

* cited by examiner
† cited by third party

*Primary Examiner* — Edwin A. Leon
(74) *Attorney, Agent, or Firm* — Li&Cai Intellectual Property (USA) Office

(57) ABSTRACT

A keyboard apparatus includes a base plate, a plurality of lifting mechanisms mounted to the base plate, and a plurality of keycaps. The keycaps are correspondingly mounted to the lifting mechanisms and are movable up and down relative to the base plate to form a pressing stroke. Each of the keycaps has a pressing surface, an assembly surface opposite to the pressing surface, and a plurality of connectors. The connectors are disposed on the assembly surface to be connected to the lifting mechanism, and a jig engagement portion protrudes from one side of at least one of the connectors. When the keycap is to be painted, the keycap is removably fixed to a painting jig by the jig engagement portion.

4 Claims, 10 Drawing Sheets

KEYCAP AND KEYBOARD APPARATUS

TECHNICAL FIELD

The present disclosure relates to a keycap and a keyboard apparatus, and more particularly to a keycap having an engagement structure to adapt for painting operations, and a keyboard apparatus having the keycap.

BACKGROUND ART

A keyboard apparatus is commonly used for inputting data into a computer, and the keycaps above a keyboard are formed with various text and symbols thereon due to different characters in use from one country to another. There are many ways for forming the text and symbols on the keycaps. In some manufacturing processes, the keycaps need to be painted to provide for the appearance of various colors. When the keycaps are to be painted, the keycaps need to be fixed to a keycap painting jig for painting, baking, printing processes and the like, and then are mounted to a base plate of a keyboard.

In a conventional manner of fixing the keycaps to the painting jig, the painting jig are generally directly fixed to connecting structures on the bottom surface of the keycap, i.e. drop-like pivoting holes, which are used to be mounted to lifting mechanisms on the base plate of the keyboard. The painting jig is disposed with engagement structures to be directly engaged in the pivoting holes of the keycaps, achieving the purpose of fixing the keycaps to the painting jig. After the painting has been completed, the keycaps are removed from the painting jig.

However, repeated use of the painting jig for painting, baking, and the like often results in dimensional changes in the engagement structures for fixing the keycaps on the painting jig. If the keycaps are fixed to the painting jig for painting, after the keycaps are subjected to plugging and unplugging processes, the connection structures of the keycaps may be deformed, so that the keycaps cannot be securely mounted to the base plate of the keyboard. The strength at which the keycaps are bound to the keyboard is affected, and even the quality test of the keyboard may be affected.

SUMMARY OF THE INVENTION

One embodiment of the present disclosure provides a keycap, so that the keycap can be fixed to a painting jig for painting and after the keycap is subjected to plugging and unplugging processes, a connection structure of the keycap is not affected, maintaining the binding strength in assembly of the keycap and the keyboard.

One embodiment of the present disclosure further provides a keycap, so that keycaps of various dimensions can be fixed to the same painting jig for painting operations.

In order to achieve the forgoing, a keycap according to the embodiments of the present disclosure is able to be assembled on a lifting mechanism of a keyboard apparatus. The keycap comprises a pressing surface, an assembly surface opposite to the pressing surface, and a plurality of connectors. The connectors are disposed on the assembly surface to be connected to the lifting mechanism, wherein a jig engagement portion protrudes from one side of at least one of the connectors; when the keycap is to be painted, the keycap is removably fixed to a painting jig by the jig engagement portion.

In order to achieve the forgoing, one embodiment of the present disclosure further provides a keyboard apparatus, comprising a base plate, a plurality of lifting mechanisms mounted to the base plate, and a plurality of keycaps. The keycaps are correspondingly mounted to the lifting mechanisms and are movable up and down relative to the base plate to form a pressing stroke. Each of the keycaps comprises a pressing surface, an assembly surface opposite to the pressing surface, and a plurality of connectors. The connectors are disposed on the assembly surface to be connected to the lifting mechanism, wherein a jig engagement portion protrudes from one side of at least one of the connectors; when the keycap is to be painted, the keycap is removably fixed to a painting jig by the jig engagement portion.

The advantageous effect of the present disclosure is that in the keycap according to the embodiments of the present disclosure, a jig engagement portion protrudes from one side of at least one of the connectors, so that when the keycap is to be painted, the keycap is removably fixed to the painting jig by the jig engagement portion. Thus, after the keycap is subjected to plugging and unplugging processes, the connection structure of the keycap is not affected.

In order to further understand the features and technical content of the present disclosure, reference can be made to the detailed description and accompanying drawings of the present disclosure. However, the accompanying drawings are only provided for reference and illustration, but not intended to limit the present disclosure.

DETAILED DESCRIPTION OF THE PREFERRED EMBODIMENTS

First Embodiment

Figure 1:
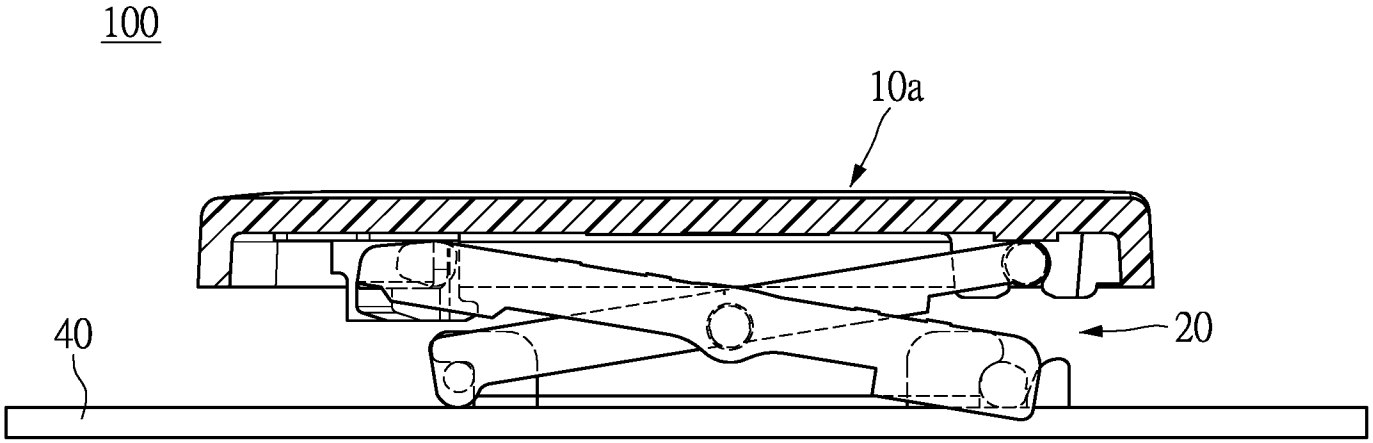
FIG. 1 is a schematic cross-sectional side view of a keycap and a keyboard apparatus of the present disclosure.

FIG. 1 is a schematic cross-sectional side view of a keycap and a keyboard apparatus of the present disclosure. The present disclosure provides a keycap 10*a* and a keyboard apparatus 100. The keyboard apparatus 100 has a base plate 40, a plurality of lifting mechanisms 20 (with one lifting mechanism as a representative in the present embodiment) mounted to the base plate 40, and a plurality of keycaps 10*a*. The plurality of keycaps 10*a* (with one keycap as a representative in the present embodiment) are correspondingly mounted to the lifting mechanisms 20.

Figure 2:
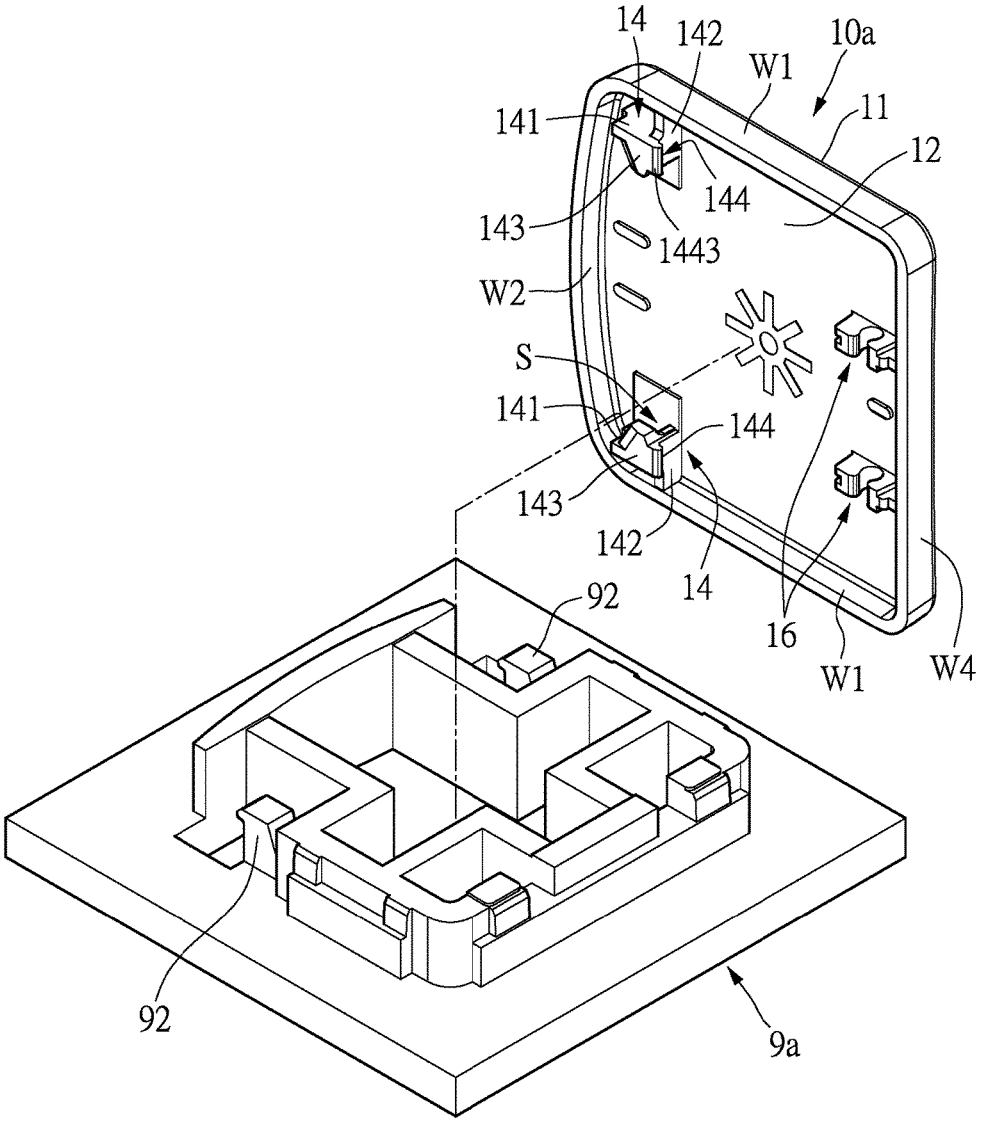
FIG. 2 is a perspective view of a keycap and a painting jig according to a first embodiment of the present disclosure.
Figure 3:
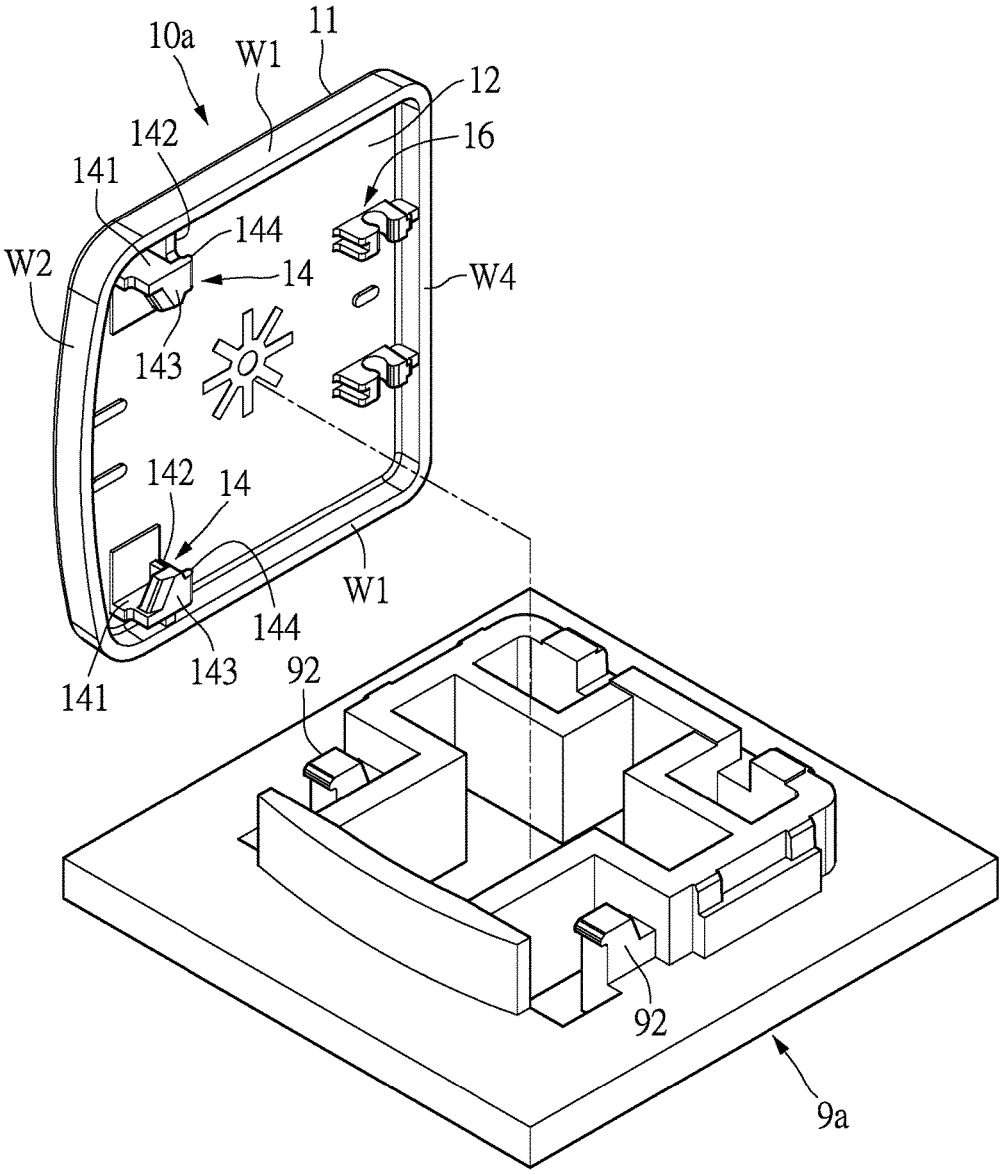
FIG. 3 is another perspective view of the keycap and the painting jig according to the first embodiment of the present disclosure.

FIGS. 2 and 3 are perspective views of a keycap and a painting jig according to a first embodiment of the present disclosure. The four sides of a keycap 10*a* have a pair of side walls W1, a front wall W2 facing a user, and a rear wall W4 away from the user. The keycap 10*a* includes a pressing surface 11, an assembly surface 12 opposite to the pressing surface 11, and a plurality of connectors (as indicated by marks 14 and 16). The connectors are disposed on the assembly surface 12 to be connected to a lifting mechanism 20 of a keyboard apparatus 100 (as shown in FIG. 1).

In the present embodiment, the connectors of the keycap 10*a* include a pair of sliding connectors 14 and a pair of pivoting connectors 16. The pair of pivoting connectors 16 is opposite to the pair of sliding connectors 14. One end of the lifting mechanism 20 is slidably connected to the sliding connectors 14 of the keycap 10*a*, and the other end of the lifting mechanism 20 is pivotally connected to the pivoting connectors 16 of the keycap 10*a*. However, the present disclosure is not limited thereto and for example, the keycap may include two pairs of sliding connectors or pivoting connectors.

When the keycap 10*a* is to be painted, the keycap 10*a* needs to be fixed to a painting jig 9*a*. According to the present disclosure, a jig engagement portion 144 is formed at one side of at least one of the connectors 14 or 16, such that the keycap 10*a* is removably fixed to the painting jig 9*a*. In the present embodiment, each of the pair of sliding connectors 14 is provided with a jig engagement portion 144; the painting jig 9*a* is provided with a pair of engaging hooks 92. The keycap 10*a* may be snap-fixed to the pair of engaging hooks 92 of the painting jig 9*a* by means of the pair of jig engagement portions 144. In addition, four sides of the painting jig 9*a* may also press against the side walls W1, the front wall W2, and the rear wall W4 at each of the four sides of the keycap 10*a*, respectively.

In the present embodiment, each sliding connector 14 includes a first stop wall 141, a second stop wall 142 connected to the first stop wall 141, and an overhanging wall 143 connected to the first stop wall 141 and the second stop wall 142. The first stop wall 141 and the second stop wall 142 are generally perpendicular to the assembly surface 12 and generally perpendicular to each other. The second stop wall 142 is located between the first stop wall 141 and the pivoting connector 16. The overhanging wall 143 is generally parallel to the assembly surface 12, and the overhanging wall 143 and the assembly surface 12 are separated by a distance to form a sliding space S. Each of the pair of sliding connectors 14 includes one of the jig engagement portions 144. The jig engagement portion 144 protrudes from one side of the overhanging wall 143 toward the pivoting connector 16 and protrudes from the second stop wall 142, and is generally parallel to the assembly surface 12.

Figure 4:
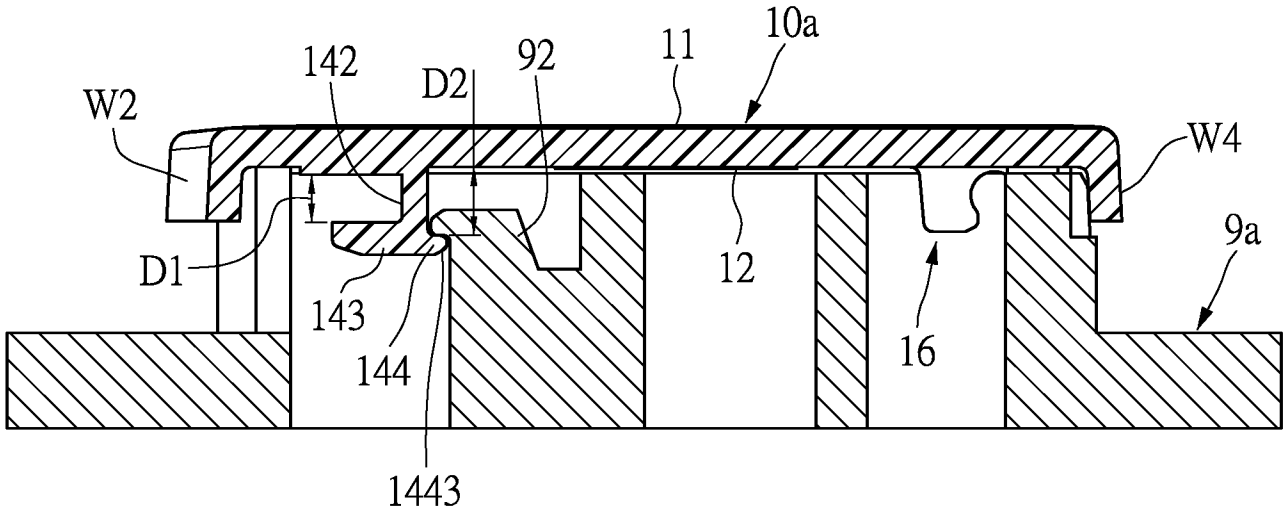
FIG. 4 is a cross-sectional view of the keycap engaged in the painting jig according to the first embodiment of the present disclosure.

Please refer to FIG. 3 and FIG. 4. FIG. 4 is a cross-sectional view of the keycap engaged in the painting jig according to the present disclosure, along a direction parallel to the side walls W1 and through one of the jig engagement portions 144. In the present embodiment, in order to make the jig engagement portion 144 engage in the painting jig 9*a* more smoothly, the jig engagement portion 144 has a guiding surface 1443 (as shown in FIGS. 2 and 4) facing away from the assembly surface 12 of the keycap 10*a*. The guiding surface 1443 may be an inclined or cambered surface. As shown in FIG. 4, a distance D2 from an inner side surface of the jig engagement portion 144 to the assembly surface 12 is greater than or equal to a distance D1 from an inner side surface of the overhanging wall 143 to the assembly surface 12. The distance D2 is preferably greater than the distance D1. Hence, a larger combination space is provided to the engaging hooks 92 of the painting jig 9*a*.

Second Embodiment

Figure 5:
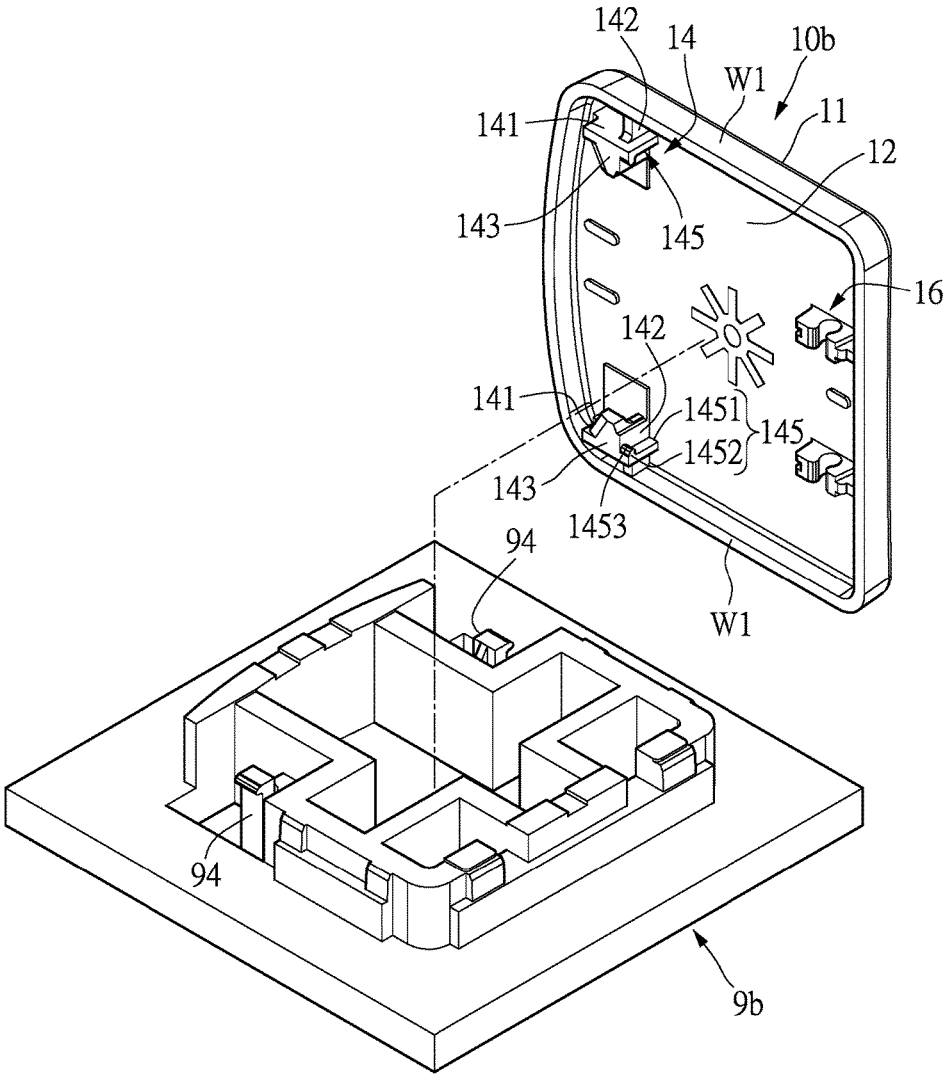
FIG. 5 is a perspective view of a keycap and a painting jig according to a second embodiment of the present disclosure.
Figure 6:
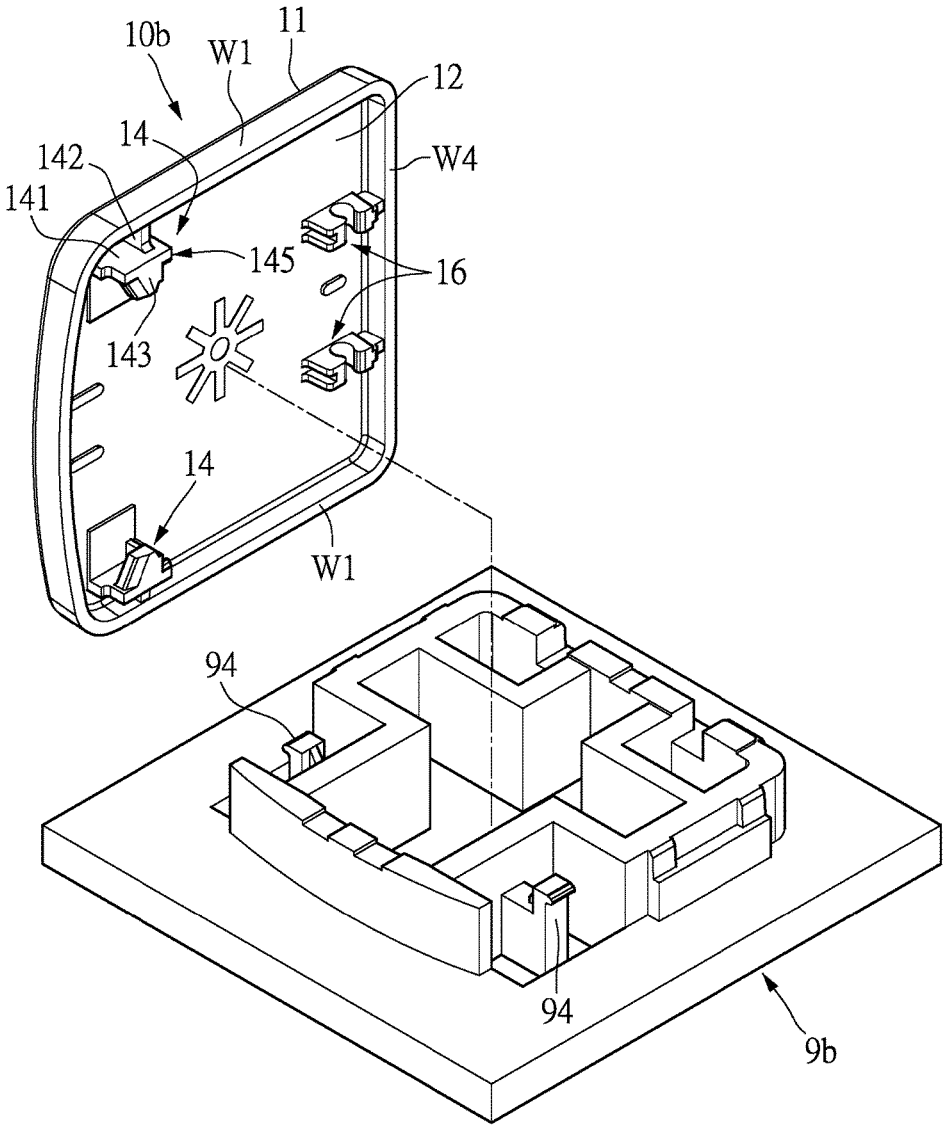
FIG. 6 is another perspective view of the keycap and the painting jig according to the second embodiment of the present disclosure.

FIGS. 5 and 6 are perspective views of a keycap and a painting jig according to a second embodiment of the present disclosure. The present embodiment is different from the previous embodiment in that a keycap 10*b* of the present embodiment has a pair of jig engagement portions 145 that are somewhat L-shaped and have a base 1451 and an engaging block 1452 connected to the base 1451. The base 1451 protrudes from the second stop wall 142 toward the pivoting connector 16, the engaging block 1452 protrudes from and is connected to the overhanging wall 143, and the pair of the engaging blocks 1452 of the pair of the jig engagement portions 145 are directed to each other. In other words, the engaging block 1452 is formed on one of the sliding connectors 14 toward the other of the sliding connectors 14.

Figure 7:
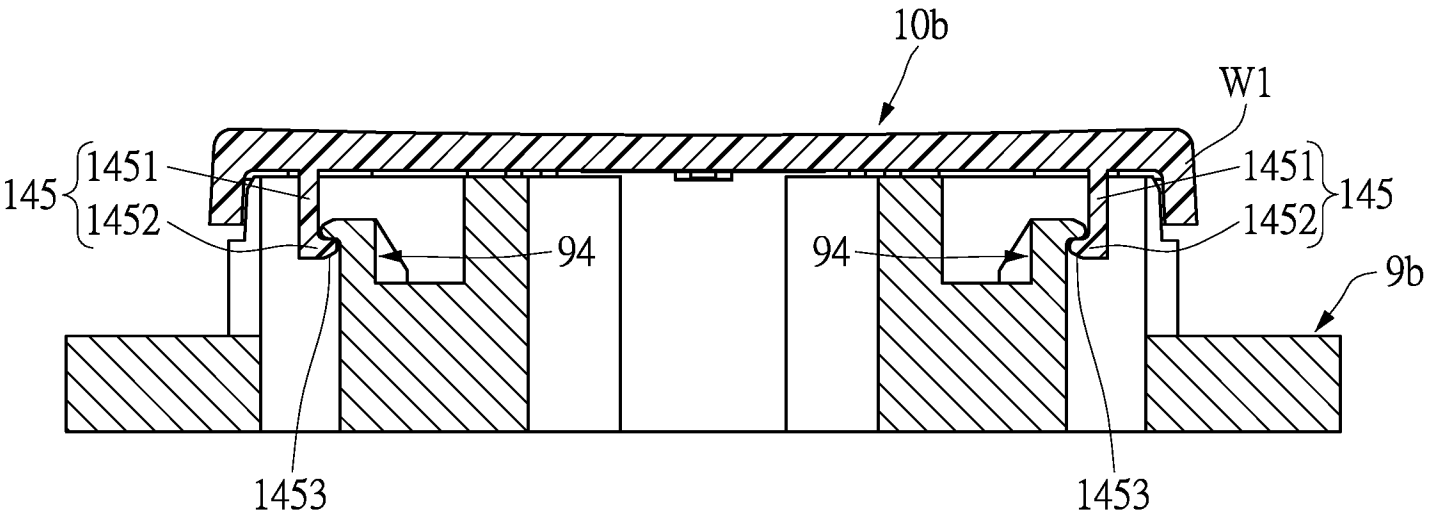
FIG. 7 is a cross-sectional view of the keycap engaged in the painting jig according to the second embodiment of the present disclosure.

Please refer to FIGS. 5 to 7. FIG. 7 is a cross-sectional view of the keycap engaged in the painting jig according to the present embodiment, along a direction parallel to the rear wall W4 and through the pair of jig engagement portions 145. The engaging block 1452 of the present embodiment also is formed with a guiding surface 1453, as shown in FIGS. 5 and 7. To mate with the jig engagement portions 145 of the keycap 10*b*, engaging hooks 94 of a painting jig 9*b* are different from those of the previous embodiment, and the engaging hooks 94 faces outwards.

Third Embodiment

Figure 8:
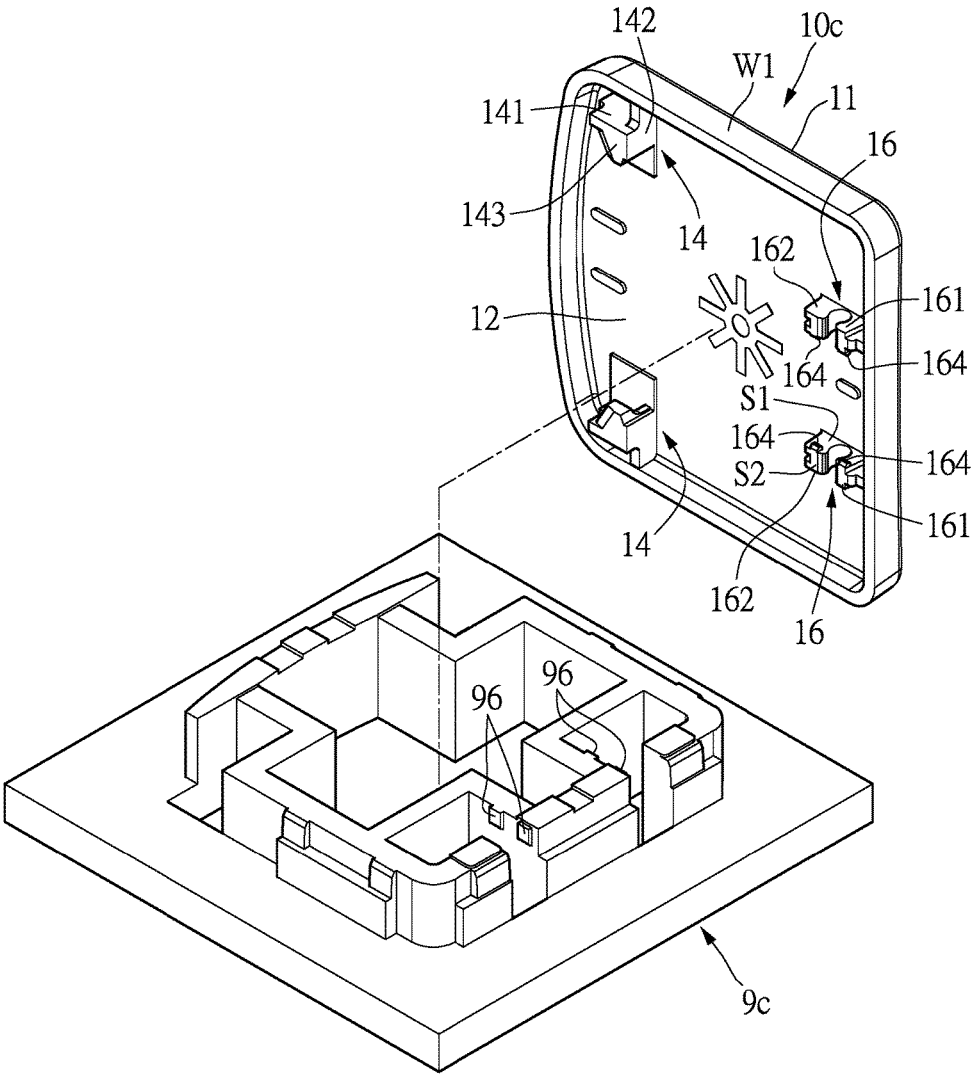
FIG. 8 is a perspective view of a keycap and a painting jig according to a third embodiment of the present disclosure.
Figure 9:
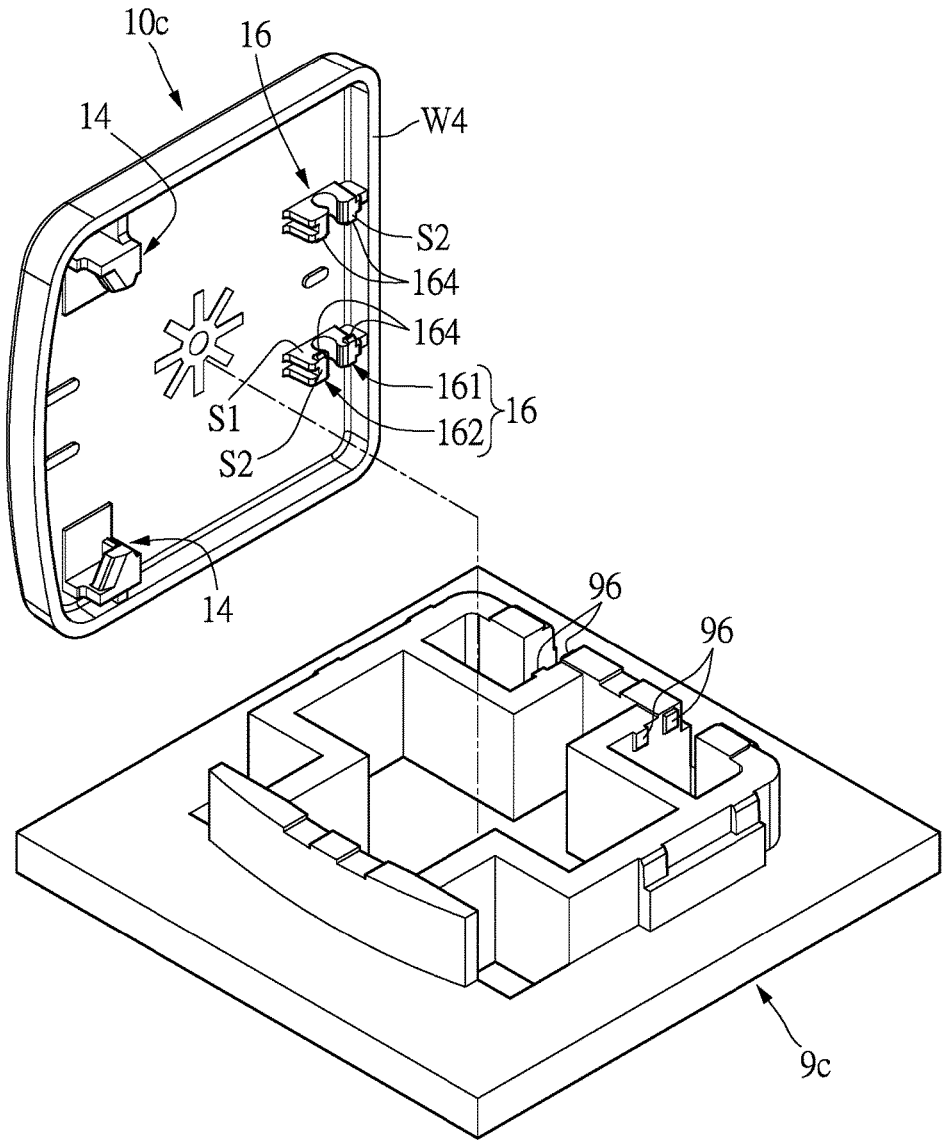
FIG. 9 is another perspective view of the keycap and the painting jig according to the third embodiment of the present disclosure.

FIGS. 8 and 9 are perspective views of a keycap and a painting jig according to a third embodiment of the present disclosure. The present embodiment is different from the previous embodiments in that a keycap 10*c* of the present embodiment has a plurality of jig engagement portions 164 formed on the pivoting connectors 16. Each of the pair of pivoting connectors 16 includes at least one jig engagement portion 164. Each of the pivoting connectors 16 has a pair of clamping blocks 161, 162, an inner side surface S1 connected to the assembly surface 12, and a bottom end surface S2 away from the assembly surface 12. The jig engagement portion 164 protrudes from the inner side surface S1 of the clamping blocks 161, 162 and is adjacent to the bottom end surface S2. In the present embodiment, one jig engagement portion 164 protrudes from each of the clamping blocks 161, 162, and there are two pairs of jig engagement portions 164 in total that are opposite to each other. In practice, only one jig engagement portion 164 may protrude from the inner side surface S1 of the clamping block 161, or only one jig engagement portion 164 may protrude from the inner side surface S1 of the clamping block 162.

Figure 10:
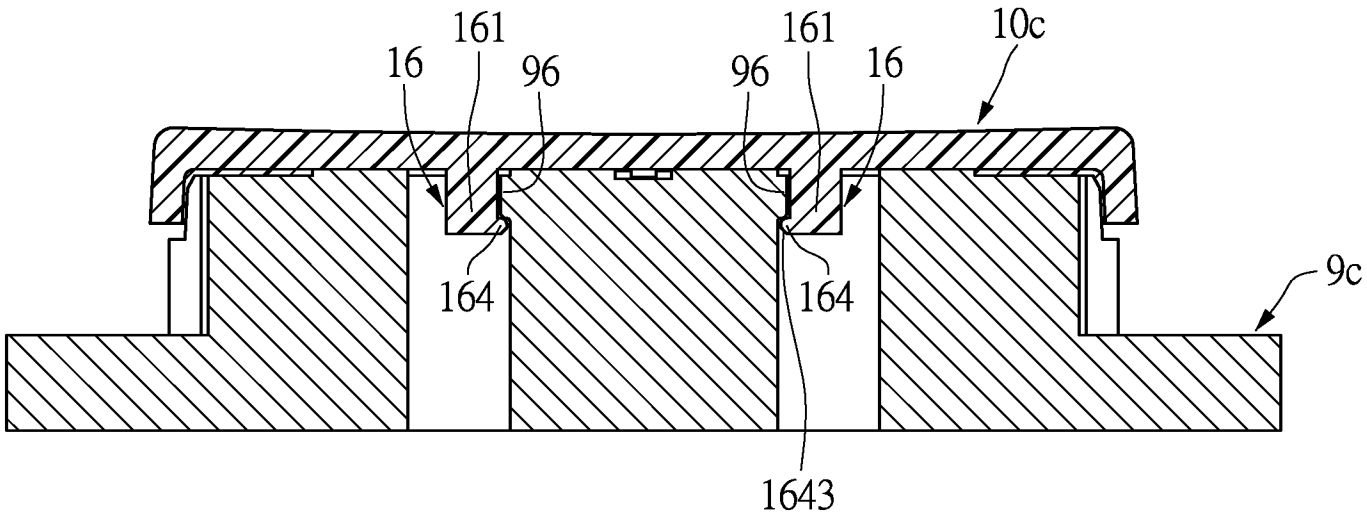
FIG. 10 is a cross-sectional view of the keycap engaged in the painting jig according to the third embodiment of the present disclosure.

Please refer to FIGS. 9 and 10. FIG. 10 is a cross-sectional view of the keycap engaged in the painting jig according to the present embodiment, along a direction parallel to the rear wall W4 and through the clamping blocks 161 of the pair of pivoting connectors 16. Each of the jig engagement portions 164 also is formed with a guiding surface 1643. To mate with the jig engagement portion 164 of the keycap 10*c*, a painting jig 9*c* is provided with four corresponding engaging hooks 96.

To sum up, the advantageous effect of the present disclosure is that in the keycap according to the embodiments of the present disclosure, the jig engagement portion is formed around at least one of the connectors, whereby the keycap is removably bound to the painting jig, avoiding the engagement of the painting jig in the pivoting connectors in the prior art. In addition, in the keycap according to the present disclosure, the jig engagement portion is formed on the connectors, whereby the engaging hooks of the same painting jig are applicable to keycaps of various dimensions, for example, square keycaps or elongated keycaps.

The descriptions above are only preferred embodiments of the present disclosure and are not intended to limit the scope of the present disclosure. All equivalents with technical changes made according to the specification and drawings of the present disclosure should fall within the scope of the present disclosure.

What is claimed is:

1. A keycap assembled on a lifting mechanism of a keyboard apparatus, the keycap comprising:

a pressing surface;

an assembly surface opposite to the pressing surface; and a plurality of connectors disposed on the assembly surface to be connected to the lifting mechanism, wherein the connectors comprise a pair of sliding connectors and a pair of pivoting connectors opposite to the pair of sliding connectors, each of the sliding connectors includes a first stop wall, a second stop wall connected to the first stop wall, and an overhanging wall connected to the first stop wall and the second stop wall, the second stop wall is located between the first stop wall and the pivoting connectors, the overhanging wall is substantially parallel to the assembly surface, and each of the pair of sliding connectors has a jig engagement portion protruding from one side of the overhanging wall toward one of the pivoting connector;

wherein a distance from the jig engagement portion to the assembly surface is greater than or equal to a distance from the overhanging wall to the assembly surface; and wherein when the keycap is to be painted, the keycap is removably fixed to a painting jig by the jig engagement portion.

2. The keycap of claim 1, wherein the jig engagement portion protrudes from the second stop wall.

3. The keycap of claim 2, wherein the jig engagement portion has a guiding surface facing away from the assembly surface.

4. A keyboard apparatus, comprising:

a base plate;

a plurality of lifting mechanisms mounted to the base plate; and a plurality of keycaps correspondingly mounted to the lifting mechanisms and movable up and down relative to the base plate to form a pressing stroke, each of the keycaps comprising:

a pressing surface;

an assembly surface opposite to the pressing surface; and a plurality of connectors disposed on the assembly surface to be connected to the lifting mechanism, wherein the connectors comprise a pair of sliding connectors and a pair of pivoting connectors opposite to the pair of sliding connectors, each of the sliding connectors includes a first stop wall, a second stop wall connected to the first stop wall, and an overhanging wall connected to the first stop wall and the second stop wall, the second stop wall is located between the first stop wall and the pivoting connectors, and the overhanging wall is substantially parallel to the assembly surface, and each of the pair of sliding connectors has a jig engagement portion protruding from one side of the overhanging wall toward one of the pivoting connector;

wherein a distance from the jig engagement portion to the assembly surface is greater than or equal to a distance from the overhanging wall to the assembly surface; and wherein when the keycap is to be painted, the keycap is removably fixed to a painting jig by the jig engagement portion.

* * * * *